US005823029A

United States Patent [19]

Eden, Jr. et al.

[11] Patent Number: 5,823,029

[45] **Date of Patent: *Oct. 20, 1998**

[54] CYLINDER LOCK SYSTEM

[75] Inventors: Charles W. Eden, Jr., Plantsville; Kenneth T. Theriault, Meriden, both of Conn.

[73] Assignee: International Security Products, Inc., Southington, Conn.

[ * ] Notice: The term of this patent shall not extend beyond the expiration date of Pat. No. 5,154,056.

[21] Appl. No.: 881,053

[22] Filed: Jun. 24, 1997

Related U.S. Application Data

[63] Continuation-in-part of Ser. No. 789,395, Jan. 29, 1997.

[51] Int. Cl.[6] ..... E05B 27/06

[52] U.S. Cl. ..... 70/358; 70/493; 70/419; 70/409

[58] Field of Search ..... 70/356, 358, 419–421, 70/493, 453, 454, 423, 427, 401, 402, 405–407, 409

[56] References Cited

U.S. PATENT DOCUMENTS

| | | | |
|---|---|---|---|
| 1,204,410 | 11/1916 | Christoph . | |
| 2,687,639 | 8/1954 | Swanson | 70/364 |
| 2,857,753 | 10/1958 | Biro | 70/421 |
| 3,264,852 | 8/1966 | Gysin | 70/358 |
| 4,122,694 | 10/1978 | Gretler | 70/406 |
| 4,434,636 | 3/1984 | Prunbauer | 70/358 |
| 4,638,651 | 1/1987 | Surko Jr. | 70/419 X |
| 4,964,288 | 10/1990 | Braun et al. | 70/406 |
| 5,170,651 | 12/1992 | Errani | 70/493 |
| 5,438,857 | 8/1995 | Kleinhany | 70/493 |
| 5,520,035 | 5/1996 | Eizen et al. | 70/409 X |
| 5,533,369 | 7/1996 | Valdajos-Gallego | 70/493 |
| 5,582,050 | 12/1996 | Haggstrom | 70/495 |

FOREIGN PATENT DOCUMENTS

| | | | |
|---|---|---|---|
| 563276 | 1/1958 | Belgium | 70/405 |
| 3038318 | 6/1981 | Germany | 70/357 |
| 3225952 | 1/1984 | Germany . | |
| 4035934 | 6/1991 | Germany | 70/356 |

*Primary Examiner*—Suzanne Dino
*Attorney, Agent, or Firm*—Alix, Yale & Ristas, LLP

[57] ABSTRACT

A cylinder lock with a resiliently biased auxiliary locking pin, the auxiliary locking pin having a first end which functions as a tenon and a second end which defines a cam follower. The first end of the auxiliary locking pin extends into the keyway and is engaged by a cooperating key blade having a longitudinal slot which defines a mortise. The second end of the auxiliary locking pin normally engages a recess in the inner diameter of the lock shell, a camming surface being provided at one side of the recess. The depth profile of the mortise increases from an initial tenon receiving depth, at the blade tip, to a functional depth, at a point displaced from the blade tip, where the locking pin is partially withdrawn from the shell recess to enable rotation of the lock core relative to the shell. Complete pin withdrawal commensurate with unlocking, in response to camming action instituted upon lock core rotation, is permitted by an aperture in the base of the key blade slot which receives a shaped pin extension which projects from the first end of the auxiliary locking pin.

30 Claims, 9 Drawing Sheets

CYLINDER LOCK SYSTEM

CROSS REFERENCE TO RELATED APPLICATION

This application is a continuation-in-part of application Ser. No. 789,395 filed Jan. 29, 1997.

BACKGROUND OF THE INVENTION (1) Field of the Invention

The present invention relates to enhancements in security devices and, particularly, to increasing the difficulty of defeating mechanical locking systems. More specifically, this invention is directed to improved lock systems and, especially, to an improved cylinder lock and cooperating keys therefor. Accordingly, the general objects of the present invention are to provide novel and improved methods and articles of such character.

(2) Description of the Prior Art

Mechanical locks which employ one or more linear arrays of pin tumblers are, of course, well known in the art. The pin tumblers, i.e., the stacks of cooperating tumbler pins, of such locks are radially displaceable, relative to the axis of rotation of a plug or core, in response to insertion of a key in a keyway provided in the core. The pin tumblers are comprised of at least an upper or driver pin, which is spring biased toward the axis of core rotation, and a driven or bottom pin which is axially aligned with the driver pin when the lock is in the locked state. The pin tumblers are received in chambers provided in the core and shell of the lock, the pin chambers in the core being in communication with the keyway of the lock and the outer circumference of the core. The pin tumbler receiving chambers of the core and shell are also in axial alignment with the lock in the locked state. A properly bitted key will, through communication with bottom pins in the pin chambers in the core, cause pin tumbler displacement which, typically, causes the interface between the axially aligned driver and bottom pins to be coincident with a shear line defined by the core outer circumference. Thus, a properly bitted key will permit the core, with the bottom pins, to rotate within the shell. Core rotation will, through the action of a cam or tail piece coupled thereto, cause operation of a latch or other similar locking mechanism.

Locks of the type generally discussed above are known in the art as "cylinder" locks. The most common manner of defeating a cylinder lock consists of "manufacture" of an unauthorized key. It is believed fair to state that it is not possible to ensure against lock defeat simply by designing an intricate keyway, i.e., a keyway having a complex profile, and/or through the use of various arrangements of pin tumblers. Rather, a high level of security dictates that the lock manufacturer have the ability to exercise key control by being the sole authorized source of key blanks which may be employed as the key portion of the system.

SUMMARY OF THE INVENTION

The present invention overcomes the above-briefly discussed and other deficiencies and disadvantages of the prior art and, in so doing, provides a novel lock system which includes a key with a blade having unique physical characteristics. This unique key blade cooperates with one or more auxiliary locking pins which are provided in the lock core.

A lock system in accordance with the invention includes a cylinder lock with a rotatable core which carries at least one auxiliary locking pin. In the locked condition of the system, the auxiliary locking pin is resiliently biased away from the keyway and across the shear line of the lock so as to engage a cooperating recess provided in the shell, the auxiliary locking pin thus aiding in inhibiting relative movement between the core and shell. The auxiliary locking pin is reciprocal along an axis which is generally transverse to a plane defined by the keyway. The axis of movement of the auxiliary locking pin preferably does not intersect the axis of core rotation, i.e., the auxiliary locking pin is displaced from a line through the center of the cylinder lock. The auxiliary locking pin is provided, at a first end, with a shaped head portion which extends into the keyway from a side thereof at all times. This shaped head portion includes a reaction surface against which an axial force may be applied.

The lock system of the invention further includes a key which is provided, in the side of the blade which faces in the direction of the auxiliary locking pin, with a longitudinal slot sized and shaped to cooperate with the head portion of the auxiliary locking pin. In a first region extending longitudinally from the blade tip toward the bow, wall(s) of the longitudinal slot which are generally complementary in shape and juxtapositioned to the auxiliary locking pin reaction surface have a first average displacement from the side of the keyway through which the auxiliary locking pin extends. This first average displacement is selected such that the shaped head portion of the auxiliary locking pin will be loosely received in the slot at the blade tip. The key blade slot wall(s) which face the auxiliary locking pin reaction surface, in a second longitudinal region displaced from the blade tip, have a second greater average displacement from the side of the keyway. This second displacement is commensurate with engagement of the auxiliary locking pin head portion and application of an axial force thereto directed oppositely to the resilient bias. The maximum displacement of the complementary shaped wall(s) of the longitudinal slot second portion is, however, insufficient to fully withdraw the auxiliary locking pin from the cooperating recess in the shell. The coaction between the slot wall(s) and the auxiliary locking pin reaction surface, i.e., the partial withdrawal of the pin, will enable rotation of the core relative to the shell to be initiated, but will not permit sufficient relative rotation to operate the lock from the locked to the unlocked state.

The second end of the auxiliary locking pin is shaped to cooperate with a shaped wall at one side of the shell recess in the manner of a cam follower and cam. Accordingly, when enabled by partial pin withdrawal, the initial rotation of the core relative to the shell will through camming action impart further axial force to the auxiliary locking pin in a direction which will tend to cause the auxiliary locking pin to move completely out of engagement with the shell recess. Such further axial movement of the auxiliary locking pin requires that the key be bitted or coded such that movement of the auxiliary locking pin head portion laterally with respect to the longitudinal slot second portion is enabled. Such enablement is achieved by providing the head portion of the auxiliary locking pin with an extension which normally terminates adjacent the base of the longitudinal slot in the key blade. This extension is sized and shaped to be received in an aperture provided in the base of the key blade slot in the second region thereof. When this further code condition is met, i.e., when the auxiliary locking pin head extension can pass into a properly located and complementary shaped aperture, the partially withdrawn auxiliary locking pin may be cammed out of locking engagement with the shell recess subsequent to partial withdrawal of the auxiliary locking pin and also subsequent to displacement of the pin tumbler stacks of the lock to the unlocked condition by the other, i.e., conventional, bitting on the blade.

A key of a locking system in accordance with the present invention must, accordingly, be provided with a properly shaped longitudinal slot or groove which will coact with the head of a locking pin to apply a pulling force to the pin, that longitudinal slot must have at least two linear portions wherein the average displacement from a keyway side of a surface provided to engage and coact with an auxiliary locking pin reaction surface is different, the blade must be provided with a properly shaped and located aperture in that portion of the slot where axial forces are being applied to the auxiliary locking pin, the blade must have a profile in addition to the longitudinal slot which is commensurate with the keyway of the lock and the blade must be bitted on the appropriate surface(s) so as to cooperate with the primary pin tumblers of the lock.

In accordance with a preferred embodiment of the invention, the head portion of the auxiliary locking pin and the cooperating slot in the side of the key blade respectively constitute a tenon and mortise.

BRIEF DESCRIPTION OF THE DRAWING

The present invention may be better understood, and its numerous objects and advantages will become apparent to those skilled in the art, by reference to the accompanying drawing, wherein like reference numerals refer to like elements in the several Figures and in which.

DESCRIPTION OF THE DISCLOSED EMBODIMENT

Figure 1:
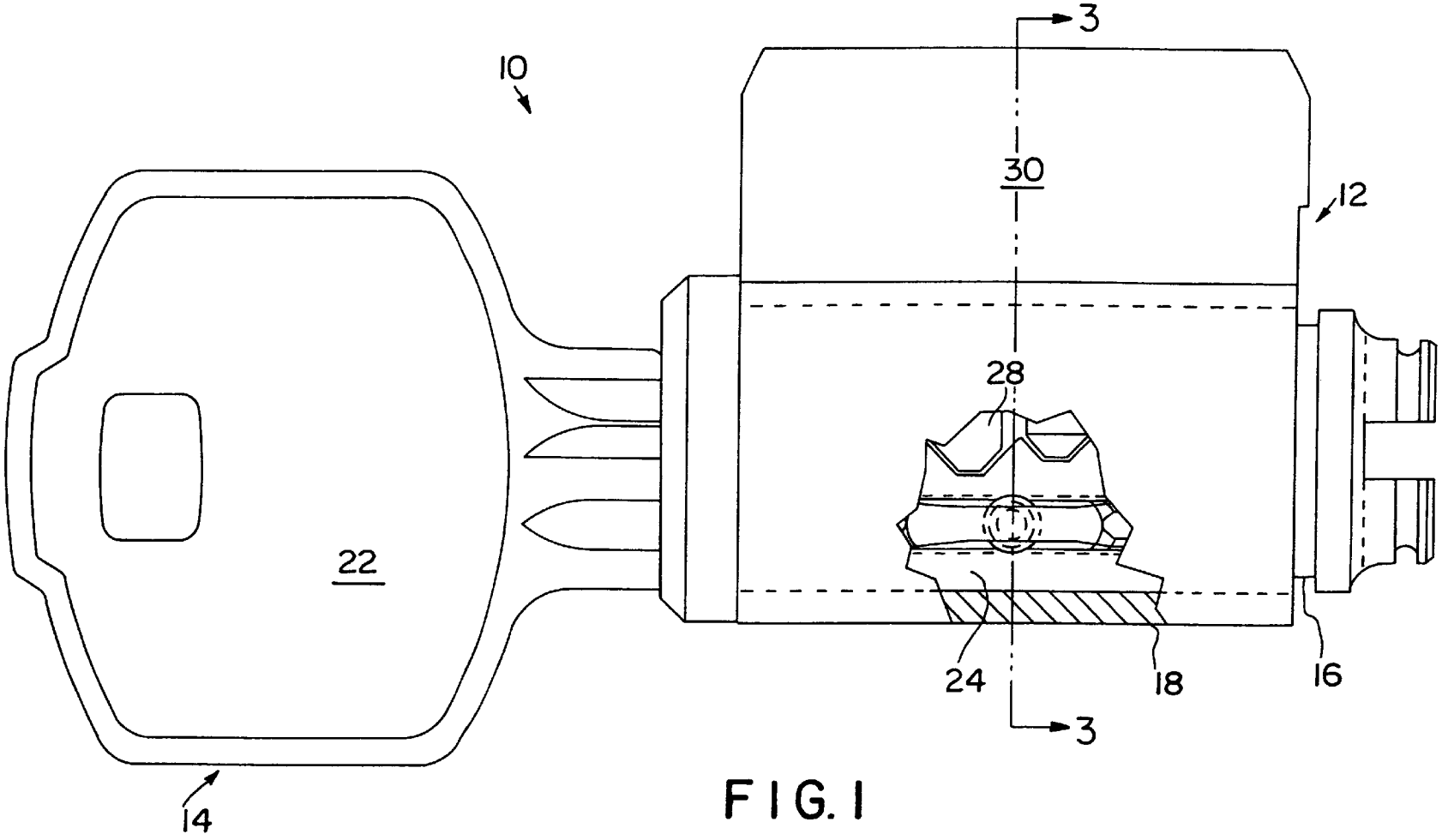
FIG. 1 is a side elevation view, partly broken away to reveal detail, of a lock system in accordance with the present invention.

The disclosed embodiment of the present invention will now be described with reference to the drawing. It is to be noted that conventional elements of the lock have been omitted from the drawing in the interest of facilitating understanding of the invention and that the various cross-sectional views of the lock are schematic illustrations rather than manufacturing drawings.

A lock system in accordance with the invention is indicated generally at 10 in FIG. 1. The lock system is comprised of a cylinder lock, indicated generally at 12, and a cooperating key 14. Cylinder lock 12, as is conventional, comprises a core 16, see also FIGS. 3–6, which is rotatable about its longitudinal axis within and relative to a shell 18. The cylindrical boundary, i.e., the interface, between core 16 and shell 18 defines the shear line or plane of the lock. The core 16 is provided with a keyway 20 having a profile, i.e., a cross-sectional shape, which is unique to the lock.

Figures 2A, 2B:
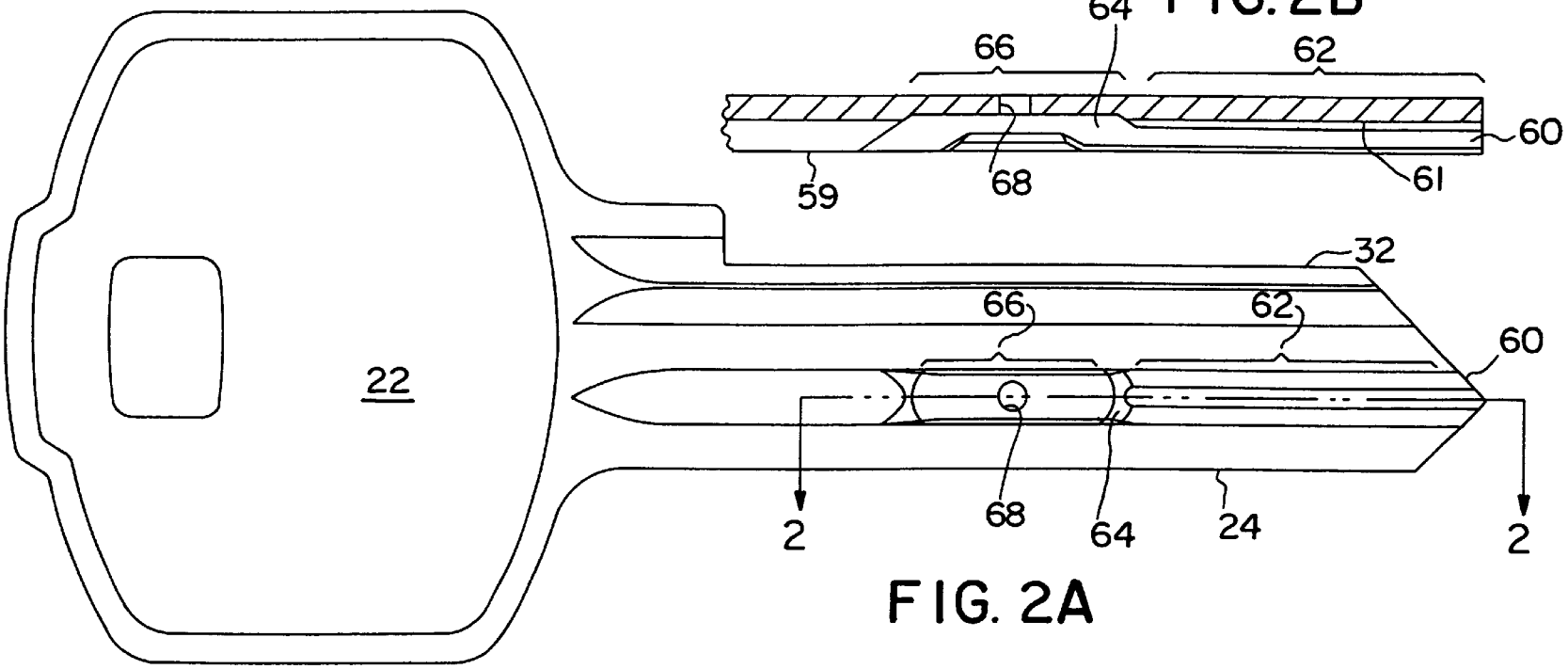
FIG. 2A is a side elevation view of a key blank from which the key of the lock system of FIG. 1 may be formed by producing the cuts which define the bitting.
FIG. 2B is a cross-sectional top plan view, taken along line 2—2 of FIG. 2A, of the blade portion of the key blank of FIG. 2A.

Referring to FIG. 2A, key 14 has a bow portion 22 and a blade 24 which extends longitudinally therefrom and terminates at a tip. Blade 24 will be shaped, i.e., the initially flat side faces of the article from which the key blank of FIG. 2A is formed will be milled, so that the profile of blade 24 matches the shape of keyway 20. Accordingly, the key blade 24 may be inserted into the keyway.

Figure 3:
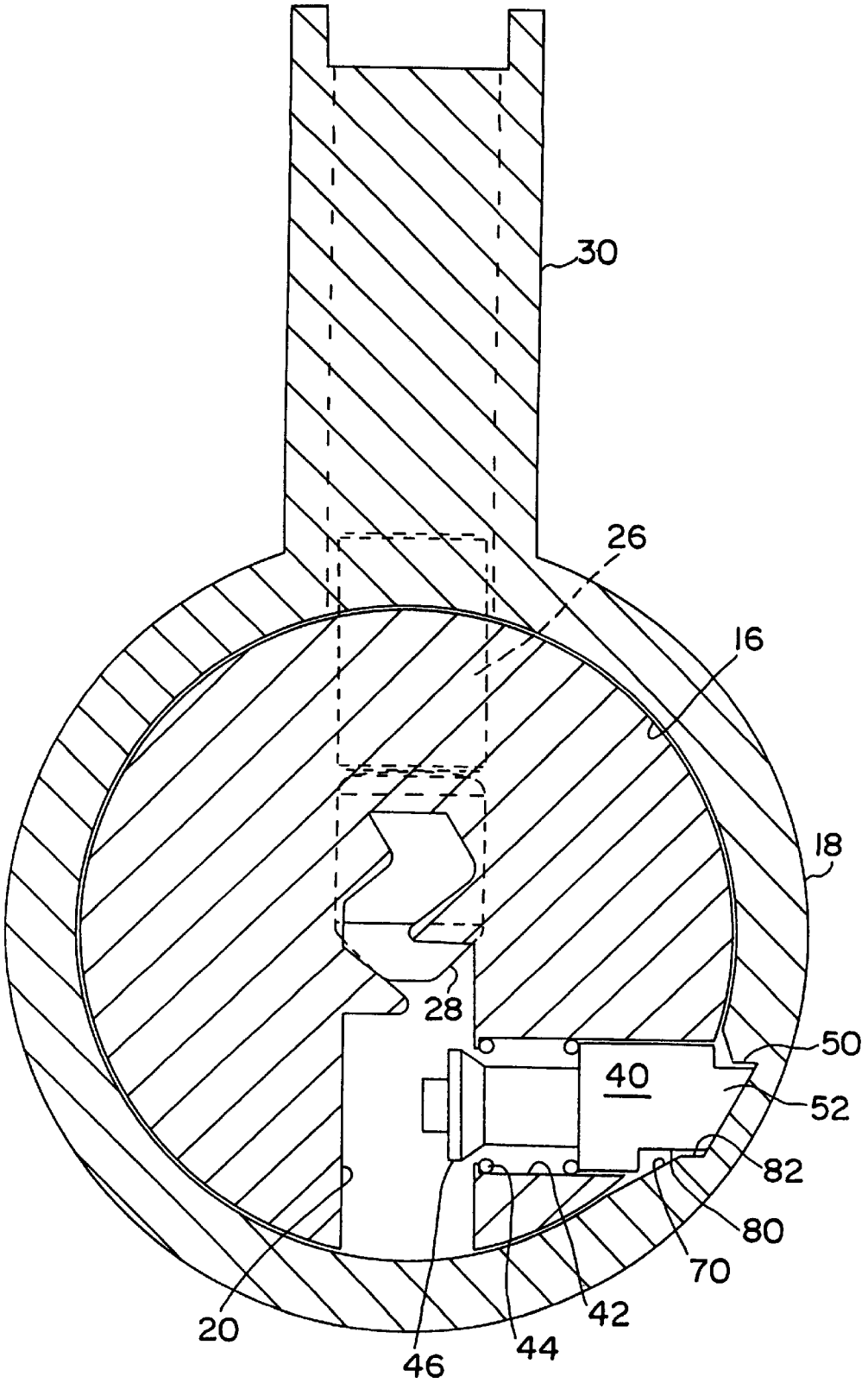
FIG. 3 is a cross-sectional, schematic side-elevation view of the lock of FIG. 1 without a key present in the keyway, FIG. 3 being a view taken along line 3—3 of FIG. 1.

As is also conventional, cylinder lock 12 will be provided with one or more arrays of reciprocally movable pin tumblers, the pin tumblers also sometimes being referred to as pin tumbler stacks. In the disclosed embodiment, the lock has a single linear array of pin tumblers. Referring to FIG. 3, each pin tumbler will comprise at least a top or driver pin 26 and a bottom or driven pin 28. The pins comprising the pin tumblers are housed in pin tumbler chambers provided in the core 16 and shell 18, the chambers in the core and shell which receive a given pin tumbler stack being in axial alignment when the lock is in the locked state and the axes of these chambers being radially oriented with respect to the axis of rotation of core 16. The pin tumbler chambers in the core communicate with the keyway and, as shown in FIG. 3, the bottom pins of each pin tumbler extend into the keyway. In the disclosed embodiment of the invention, the pin tumblers are, in part, housed in an extension 30 of shell 18, such an extension being known in the art as a "bible". It will be understood that the pin tumblers are biased in the direction of the axis of rotation of core 16 by springs, not shown. In the locked condition of the cylinder lock, one of the pins of each pin tumbler extends across the shear line, i.e., is partly in a chamber in each of the shell and core, and thus prevents rotation of the core relative to the shell. Rotation of the core relative to the shell is conventionally enabled by providing the key blade with bitting, i.e., surface irregularities, which engage the bottom pins and cause the pin tumblers to be displaced so that the interface between the driver and bottom pins is located on the shear line. In the embodiment disclosed, the key bitting would, as may be seen from FIG. 1, be in the form of flat bottomed serrations provided in edge 32 of key blade 24. It will, however, be understood that cylinder lock 12 may have one or a plurality of arrays of pin tumblers, and that the key bitting which cooperates with such pin tumblers may be on an edge(s) and/or side faces of the key blade and/or may take various forms and the axes along which the pins move do not have to be radially oriented with respect to the axis of core rotation.

In accordance with the present invention, and as best seen from FIGS. 3–6, cylinder lock 12 is provided with at least one auxiliary locking pin 40. Pin 40 is housed, for reciprocal motion, in a pin chamber 42 in core 16. Chamber 42 extends between a side of keyway 20 and the outer circumference of the core. Pin chamber 42 is provided with an inwardly extending rim or shoulder which functions as a seat for the first end of a biasing spring 44. The opposite end of biasing spring 44 coacts with a shoulder 45 on pin 40 (see FIG. 7), i.e., spring 44 is in compression and surrounds a reduced diameter intermediate portion of pin 40. Spring 44 thus biases pin 40 outwardly, i.e., in a direction generally transverse to a plane defined by and extending through the center of keyway 20. The axes of the above-described pin tumblers, in the disclosed embodiment, lie in this plane. In contradistinction to the above-described principal pin tumblers, the axis along which the auxiliary locking pin 40 moves does not intersect the axis of rotation of core 16. Auxiliary locking pin 40 is, accordingly, offset with respect to a center line of the core.

Figure 7:
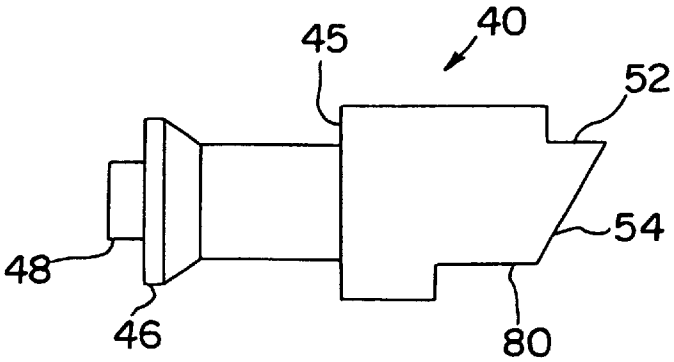
FIG. 7 is an enlarged side elevation view of the auxiliary locking pin of the lock of FIGS. 1 and 3–6.

Referring to FIG. 7, which is an enlarged view of auxiliary locking pin 40, at a first end the pin includes a shaped head 46 which, when viewed in cross-section in a plane transverse to the keyway, generally has the shape of a tenon which flares, i.e., enlarges, in the direction of the side of the keyway opposite to that through which pin 40 extends. Thus, the head 46 of auxiliary locking pin 40, from the reduced diameter intermediate portion thereof, tapers outwardly to a cylindrical region. This tapered, i.e., frusto-conical, portion of head 46 defines, as will be described below, a first reaction surface against which an axial force is applied. The first end of auxiliary locking pin 40 is defined by an extension 48 of head 46 having a predetermined length, cross-sectional size and shape. In the disclosed embodiment, extension 48 is of cylindrical shape and is coaxial with pin 40.

The second or opposite end of auxiliary locking pin 40, i.e., the portion of pin 40 disposed on the shell side of the reduced diameter intermediate portion, is sized and shaped to cooperate, in the manner to be described below, with a recess 50 provided in the inner wall of shell 18. Referring jointly to FIGS. 3, 4A, 5A and 7, the second end of pin 40 includes a projection 52 sized and shaped to enter recess 50. The outwardly facing side of projection 52, i.e., the end of pin 40 disposed oppositely with respect to extension 48, defines a surface 54 which, in the manner to be described, permits auxiliary locking pin 40 to function as a cam follower. Restated, axial motion may be imparted to pin 40 by means of the application of force to cam surface 54. As clearly shown, the surface or face 54 at the end of pin 40 intersects the axis of the pin at an angle. Thus, in the clockwise direction of rotation of the core relative to the shell, the trailing edge of face 54 is displaced further from the keyway defined plane than is the leading edge. With the lock in the locked state as represented by FIG. 3, projection 52 is received in recess 50 and auxiliary locking pin 40 thus bridges the shear line of the lock and cooperates with the primary pin tumblers to prevent relative rotation between the core and shell. In this state, a pair of abutting walls 80 and 82, oriented generally parallelly with respect to the axis of pin 40 in the disclosed embodiment, respectively on the projection 52 and in recess 50, coact to prevent rotation of core 16 relative to shell 18.

Referring again to FIGS. 2A and 2B, and also referring to FIGS. 4–6, the side 59 of blade 24 of key 14 which faces the side of the keyway through which auxiliary locking pin 40 extends is provided with a longitudinal slot 60. Slot 60 has a shape which is generally complementary to that of head 46 of pin 40. Thus, extending longitudinally from the blade tip, blade 24 has a slot 60 which functions as a mortise which receives and coacts with the tenon defined by the head 46 of auxiliary locking pin 40. The walls of slot 60 which operatively engage the head of pin 40 are displaced from the side of the key blade in which the slot is formed, and thus also from the facing side of the keyway, this displacement hereinafter being referred to as the operational slot depth. Slot 60 also has an overall depth measured between the base 61 of slot 60 and the outermost plane defined by side 59 of blade 24. Slot 60 has a first overall depth and a first operational depth in a first linear section 62 thereof which extends inwardly from the blade tip. Slot 60 also includes, in the disclosed embodiment, a ramp, i.e., a second linear section, 64 where both its overall depth and operational depth transition from first or initial depths to second depths. Slot 60 further has at least a third linear section 66 having the second overall and operational depths. An aperture or through hole 68 is provided in the base 61 of the key blade in linear portion 66. Preferably, the size and shape of aperture 68 is complementary to the cross-sectional size and shape of extension 48 of head 46 of pin 40.

FIG. 3 depicts the disclosed embodiment of a lock in accordance with the present invention in the locked state, i.e., without a key inserted in keyway 20. In this condition, the bottom pins of the primary pin tumblers are resiliently biased into the keyway. The head 46 of auxiliary locking pin 40 also extends into the keyway. In the locked state of FIG. 3, the second end of pin 40, namely the projection 52, is fully engaged in recess 50 in the wall of shell 18. Thus, in the FIG. 3 state, rotation of core 16 relative to shell 18 is prevented by the extension, across the shear line, of a pin of each of the primary pin tumblers and by the auxiliary locking pin 40. The head 46 of auxiliary locking pin 40, in the preferred embodiment, normally extends into the keyway to a position where it does not cross the center plane of the keyway.

Figure 4A:
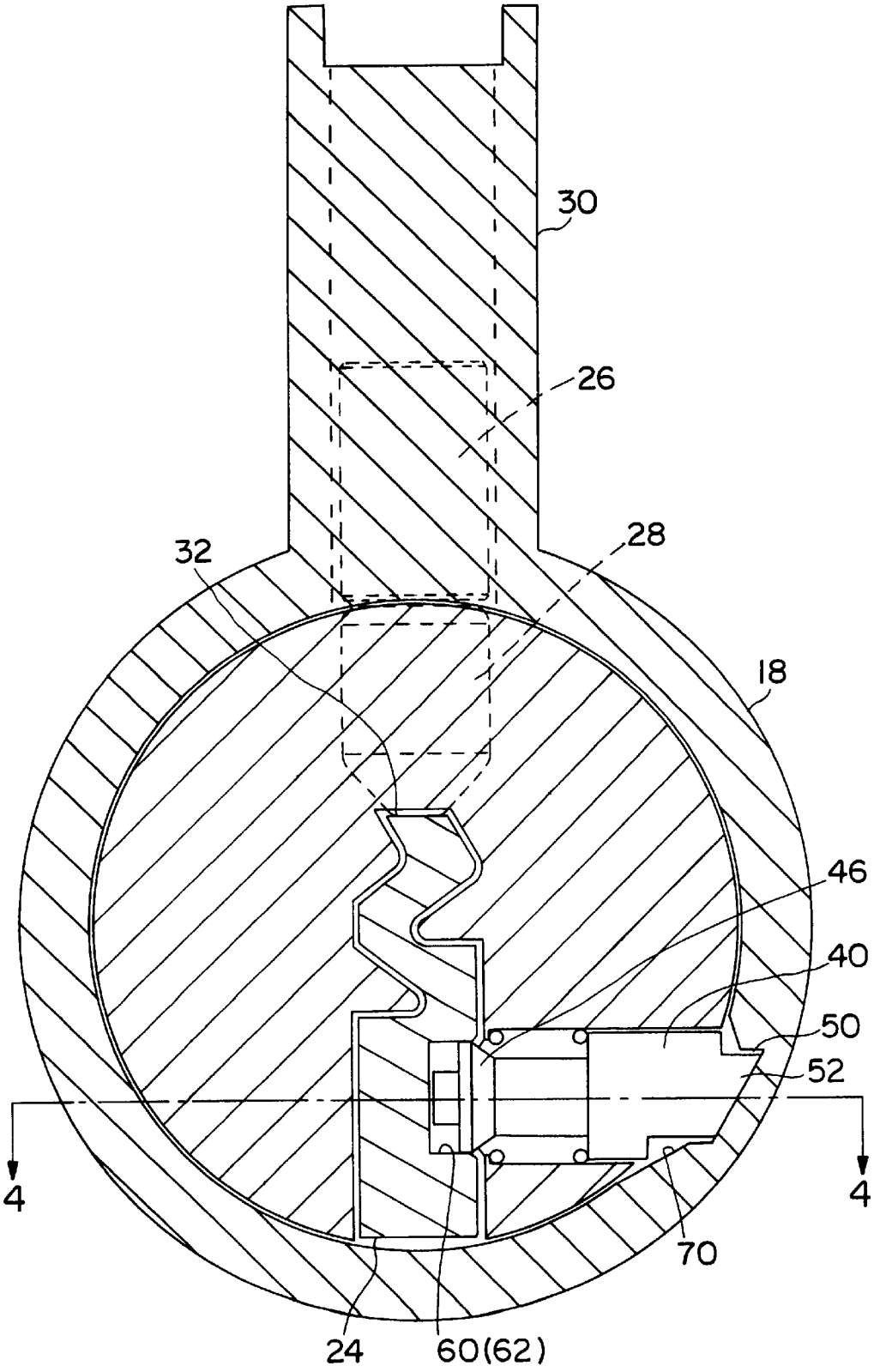
FIG. 4A is a view similar to FIG. 3 but with an authorized key partly inserted in the keyway.
Figure 4B:
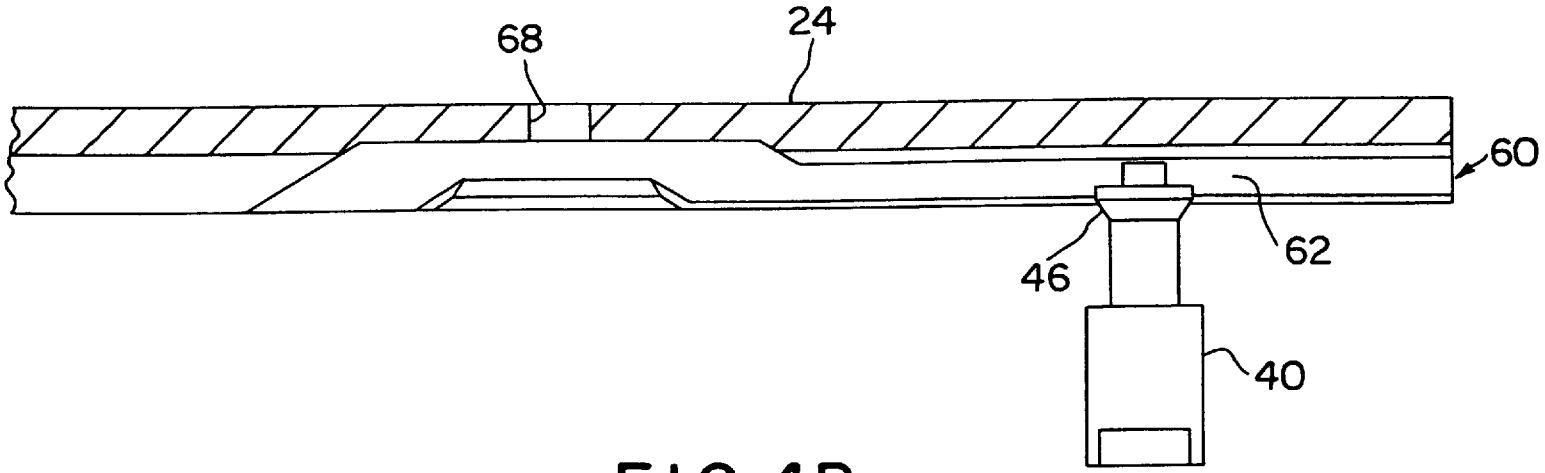
FIG. 4B is a partial view taken along line 4—4 of FIG. 4A.

When an authorized key is started into keyway 20, as represented in FIGS. 4A and 4B, the head portion 46 of pin 40 will be received in the first section 62 of slot 60. The first overall and operational depths of slot 60 are selected such that the key will initially slide relative to the auxiliary locking pin without any significant force being transferred to the pin reaction surface, i.e., the tenon, by the complementary shaped inwardly facing surfaces of groove 60, i.e., the mortise. Restated, the initial displacement of the mortise defining walls from the keyway side, commensurate with the first slot operational depth, is insufficient to pull pin 40 inwardly.

Figure 5A:
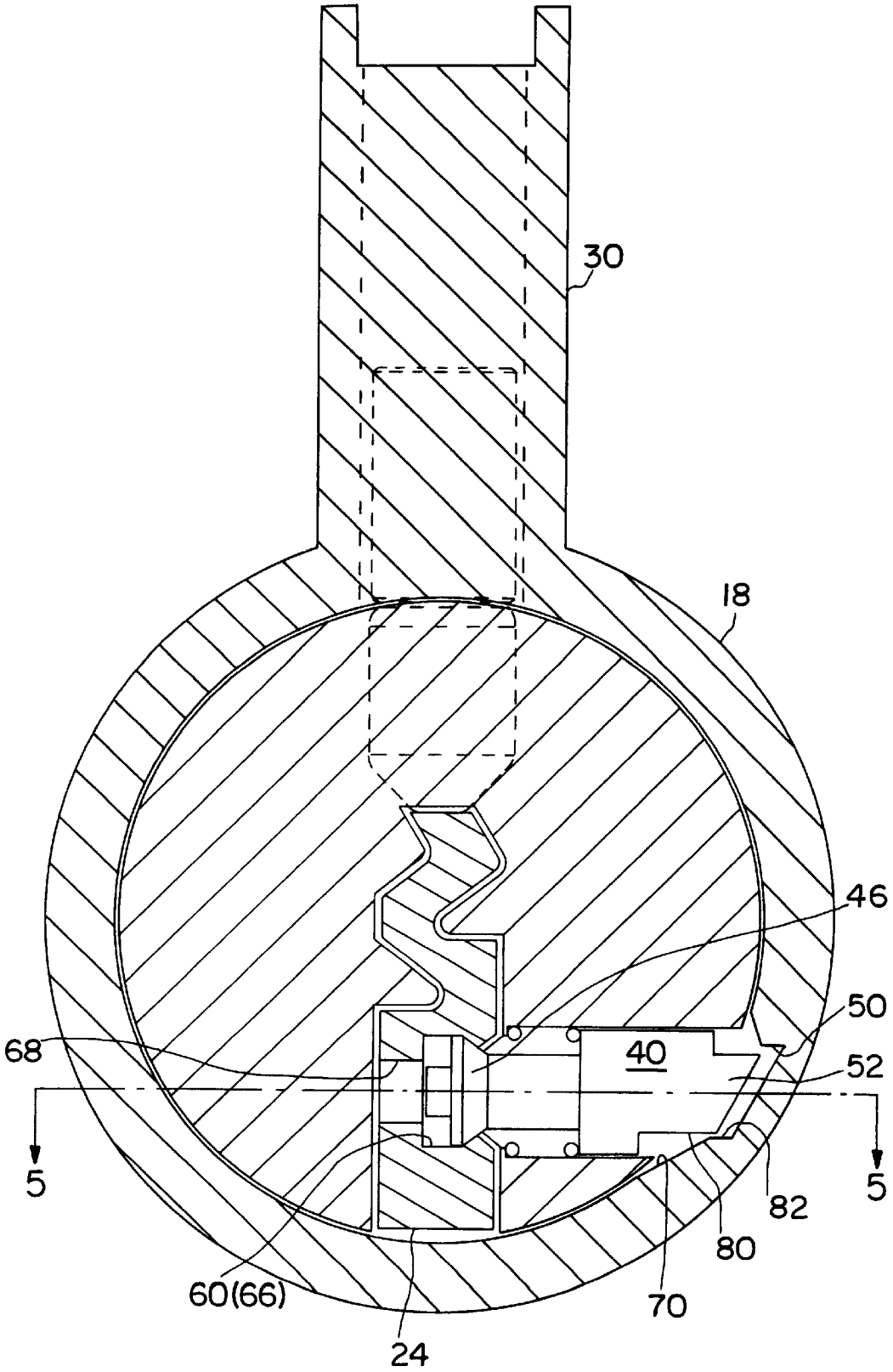
FIG. 5A is a view identical to FIG. 4A but with the key fully inserted in the keyway.
Figure 5B:
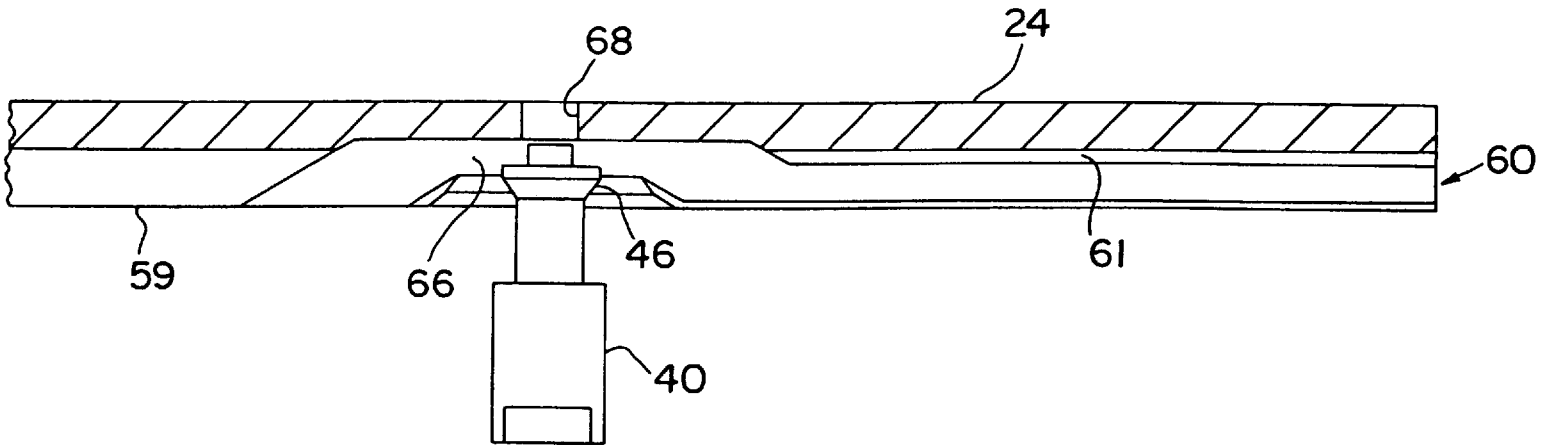
FIG. 5B is a partial view identical to FIG. 4B taken along line 5—5 of FIG. 5A.

When the key blade 44 is fully inserted in the keyway 20, i.e., when the condition depicted in FIGS. 5A and 5B is reached, a ramp portion of slot 60, the section 64 in the disclosed embodiment, will have coacted with the head 46 of pin 40 to pull pin 40 outwardly against the bias of spring 44. Restated, the transition of longitudinal slot 60 from the linear first operational depth portion to the deeper second operational depth portion will cause an axial force to be applied to the reaction surface on the head 46 of pin 40 by the complementary surface which in part defines slot 60. This will result in the auxiliary locking pin 40 being partially withdrawn from recess 50 in shell 18. This partial withdrawal "raises" pin which is parallel to the pin axis 40 so that the wall 80 on the pin no longer abuts the complementary shaped recess defining wall 82 and the downstream or leading edge of cam surface 54 in the clockwise direction of core rotation is thus disposed on the core side of recess side wall surface 82. Restated, the coaction between the slot in the key blade and head of the auxiliary locking pin will impart sufficient axial movement to pin 40, against the bias of spring 44, to discontinue the rotation blocking cooperation between pin 40 and recess 50 and, thereby, enable core rotation. However, absent the aperture 68 in the base of slot 60, presuming that the key blade is otherwise correctly bitted, rotation of core 16 relative to shell 18 to the point where the latch coupled to core 16 could be operated would be prevented. Partial withdrawal of the auxiliary locking pin 40 from engagement in recess 50, as depicted in FIGS. 5A and 5B, thus does not permit lock operation because full rotation of core 16 is still prevented by interference between a camming surface 70, provided on the inner wall of the shell immediately adjacent wall 82 of recess 50, and an axially immobilized auxiliary locking pin, i.e., a locking pin that cannot move further in the axial direction into the keyway because the extension 48 bottoms in slot 60.

Figure 6A:
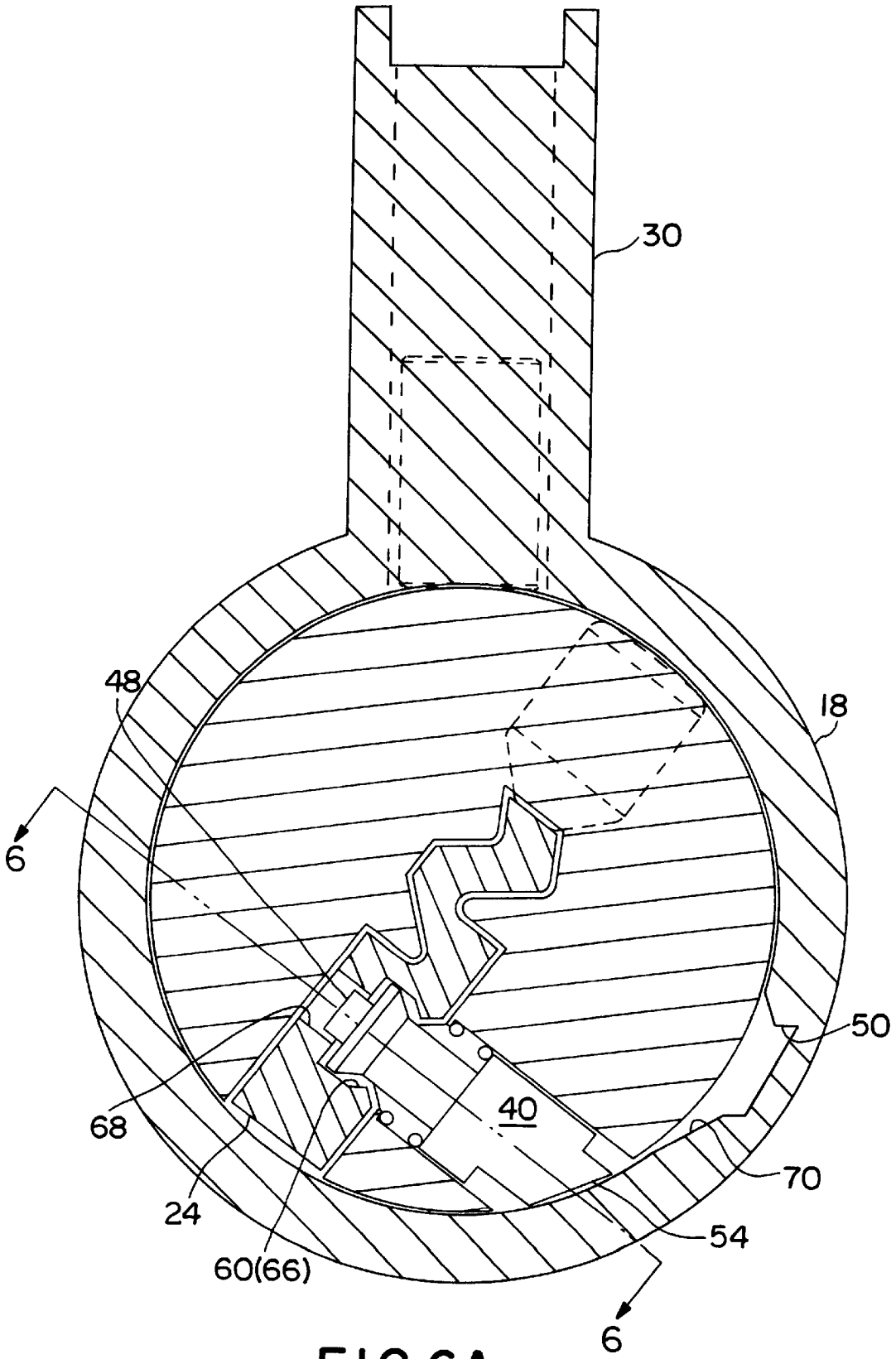
FIG. 6A is view identical to FIG. 5A depicting the lock core rotated relative to the shell.
Figure 6B:
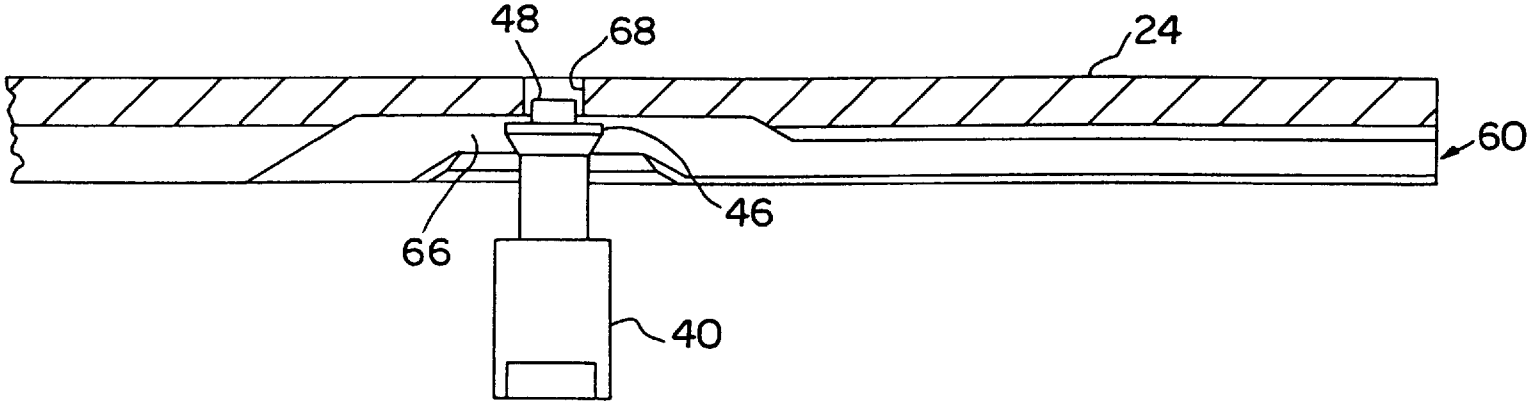
FIG. 6B is a partial view taken along line 6—6 of FIG. 6A.

Referring to FIGS. 6A and 6B, with the aperture 68 present in the key blade, the camming surface 70 on shell 18 will cooperate with cam surface 54 on projection 52 of auxiliary locking pin 40 to produce an axial force which drives the extension 48 on the head 46 of pin 40 into aperture 68 in response to the application of torque to bow 22 of key 20. In the preferred embodiment, in the unlocked state depicted in FIG. 6A, at least a portion of the head 46 of auxiliary locking pin 40 extends across the plane of the center of the keyway.

In a lock in accordance with the present invention, the most outwardly disposed surface area(s) of the projecting second end 52 of the auxiliary locking pin, i.e., the cam surface 54 in the disclosed embodiment, are preferably, but are not necessarily, generally complementary in shape to the inner diameter of shell 18. As may clearly be seen from FIG. 6A, in the interest of manufacturing economy, surface 54 may be flat and approximately tangent to the curve defined by the inner surface of shell 18. Also, referring to FIG. 2A, the longitudinal slot 60 in the key blade is preferably continued past the location of the auxiliary locking pin and will preferably transition back to at least its initial depth. This extension of slot 60 is in the interest of facilitating the cleaning thereof. As will be obvious to those skilled in the art, it is possible to employ a plurality of the auxiliary locking pins 40. Where a plurality of auxiliary locking pins is employed, they could enter the keyway from opposite sides. Further, while the slot 60 in the key blade preferably has linear portions of different "depth", i.e., the operational and overall depth of slot 60 changes in stepwise fashion, slot 60 could vary constantly from initial depths, at which the slot receives but does not impose force on the auxiliary locking pin, to a linear region having the functional, i.e., second, depth where the aperture 68 is located.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A cylinder lock comprising:

a shell, said shell having a plurality of pin tumbler receiving chambers, said shell further having an interior surface which defines a core receiving chamber having a longitudinal axis, said shell pin tumbler receiving chambers each extending to said shell interior surface and having an axis, said shell interior surface being provided with at least a first recess, said first recess having a depth and being in part defined by a side wall and a camming surface which extends from said side wall and merges with said shell interior surface, said shell being mounted with a fixed orientation in the use environment of said lock;

a core cooperating with said shell to form the relatively rotatable component of said lock, said core having an exterior surface and being disposed within said core receiving chamber of said shell for rotation about said longitudinal axis, said core including a longitudinally extending keyway, said keyway having oppositely disposed first and second sides and defining a plane in which said longitudinal axis lies, said core also having a plurality of pin tumbler receiving chambers, each of said core pin tumbler receiving chambers having an axis, each of said core pin tumbler receiving chambers being located so as to be axially alignable with an associated one of said shell pin tumbler receiving chambers when said lock is in the locked state, said core pin tumbler receiving chambers extending between said keyway and said exterior surface of said core, a shear line for said lock being defined by the interface between said interior surface of said shell and said exterior surface of said core, said core further having at least a first auxiliary locking pin receiving chamber which has an axis, said auxiliary locking pin receiving chamber axis extending linearly between said first side of said keyway and said core exterior surface, said first auxiliary locking pin receiving chamber axis being in registration with said shell first recess when said pin tumbler receiving chambers of said shell and core are in axial alignment;

a plurality of pin tumblers, said pin tumblers each having at least a bottom pin and a driver pin, said pins each having an axis and said pins of each of said pin tumblers being in axial alignment when said core and shell pin tumbler receiving chambers are in axial alignment whereby said pin tumblers are reciprocally movable as units when said lock is in the locked state, said pin tumblers each further including a first spring for urging said driver pins in the direction of said keyway whereby at least one of said pins of at least some of said pin tumblers normally extends across said shear line so as to be partly disposed in an aligned shell pin tumbler receiving chamber and core pin tumbler receiving chamber;

an auxiliary locking pin having first and second oppositely disposed end portions, said auxiliary locking pin being in part disposed in said core auxiliary locking pin receiving chamber for reciprocal motion, said auxiliary locking pin defining an axis, said first end portion of said auxiliary locking pin including a shaped head, said shaped head at all times extending into said keyway through said first side of said keyway, said second end portion of said auxiliary locking pin extending across said shear line and being received in said first recess in said shell interior surface when said lock is in the locked state, said shaped head of said auxiliary locking pin including a reaction surface against which a force directed axially with respect to said auxiliary locking pin may be exerted, said reaction surface facing generally toward said second end portion of said auxiliary locking pin, said auxiliary locking pin first end portion also including an extension of said shaped head, said extension projecting beyond said reaction surface toward said second side of said keyway, said auxiliary locking pin second end portion including a cam surface shaped to cooperate with said shell recess defining camming surface to impart axial motion to said auxiliary locking pin; and an auxiliary locking pin spring for applying an axial resilient bias force to said auxiliary locking pin to urge said auxiliary locking pin toward said shell interior surface whereby said auxiliary locking pin will normally extend across said shear line and said second end portion thereof will be received in said shell first recess, said auxiliary locking pin cooperating with said shell first recess defining sidewall to prevent rotation of said core relative to said shell in the absence of the application of forces to said auxiliary locking pin which are in a direction opposite to and in excess of said resilient bias force.

2. The cylinder lock of claim 1 wherein each of said shell first recess and said locking pin second end portion is provided with a rotation prevention wall surface, said wall surfaces being oriented generally parallelly with respect to said auxiliary locking pin axis when said auxiliary locking pin is received in said shell first recess under the influence of said auxiliary locking pin spring, said shell first recess rotation prevention wall surface comprising a portion of said recess defining side wall, the length of said shell rotation prevention wall surface being less than the depth of said shell first recess, said rotation prevention wall surfaces coacting to prevent rotation of said core relative to said shell in the locked state of said lock.

3. The cylinder lock of claim 1 wherein said head of said auxiliary locking pin in part defines a flaring tenon.

4. The cylinder lock of claim 2 wherein said head of said auxiliary locking pin in part defines a flaring tenon.

5. The cylinder lock of claim 2 wherein said shell rotation prevention wall surface ends at said camming surface at a first side of said first recess whereby said shell rotation prevention and camming surfaces cooperate to define a first side of said shell first recess in a first direction of rotation of said core relative to said shell and wherein said auxiliary locking pin cam surface at least in part defines an end face of said second end portion of said auxiliary locking pin, said end face extending angularly from said auxiliary locking pin rotation prevention wall surface and intersecting said auxiliary locking pin axis at an angle.

6. The cylinder lock of claim 5 wherein said head of said auxiliary locking pin in part defines a flaring tenon.

7. The cylinder lock of claim 1 wherein said auxiliary locking pin second end portion cam surface comprises at least a part of an end face of said auxiliary locking pin, said cam surface intersecting said auxiliary locking pin axis at an angle.

8. The lock of claim 1 wherein said auxiliary locking pin axis is oriented substantially transverse to said keyway defined plane and intersects said plane at a point offset from said longitudinal axis.

9. The cylinder lock of claim 8 wherein said auxiliary locking pin second end portion cam surface comprises at least a part of an end face of said auxiliary locking pin, said cam surface intersecting said auxiliary locking pin axis at an angle.

10. The cylinder lock of claim 9 wherein each of said shell first recess and said locking pin second end portion is provided with a rotation prevention wall surface, said wall surfaces being oriented generally parallelly with respect to said auxiliary locking pin axis when said auxiliary locking pin is received in said shell first recess under the influence of said auxiliary locking pin spring, said shell first recess rotation prevention wall surface comprising a portion of said recess defining side wall, the length of said shell rotation prevention wall surface being less than the depth of said shell first recess, said auxiliary locking pin rotation prevention wall surface extending from a first end of said auxiliary locking pin cam surface, said rotation prevention wall surfaces coacting to prevent rotation of said core relative to said shell in the locked state of said lock.

11. The cylinder lock of claim 10 wherein said head of said auxiliary locking pin in part defines a flaring tenon, at least a portion of said tenon comprising said reaction surface.

12. A cylinder lock system comprising:

a shell, said shell defining a plurality of pin tumbler receiving chambers, said shell further having an interior surface which defines a core receiving chamber having a longitudinal axis, said shell pin tumbler receiving chambers each having an axis and communicating with said interior surface, said shell interior surface being provided with at least a first recess having a side wall, said shell being mounted with a fixed orientation in the use environment of the lock of said system;

a core cooperating with said shell to form the relatively rotatable component of the lock of said system, said core having an exterior surface and being disposed within said core receiving chamber of said shell for rotation about said longitudinal axis, said core including a longitudinally extending keyway, said keyway having oppositely disposed first and second sides and defining therebetween a plane in which said longitudinal axis lies, said core also having a plurality of pin tumbler receiving chambers, said core pin tumbler receiving chambers each having an axis, each of said core pin tumbler receiving chambers being axially alignable with an associated one of said shell pin tumbler receiving chambers, said core pin tumbler receiving chambers extending between said keyway and said exterior surface of said core, a shear line for the lock of said system being defined by the interface between the interior surface of said shell and said exterior surface of said core, said core further having at least a first auxiliary locking pin receiving chamber which has an axis, said auxiliary locking pin receiving chamber axis extending linearly between said first side of said keyway and said core exterior surface, said auxiliary locking pin receiving chamber axis being in registration with said shell first recess when said pin tumbler receiving chambers of said shell and core are in axial alignment;

a plurality of pin tumblers, said pin tumblers each having at least a bottom pin and a driver pin, said pins each having an axis, said pin tumblers being disposed in said pin tumbler receiving chambers with the pins of each pin tumbler being in axial alignment when said core and shell pin tumbler receiving chambers are in axial alignment, reciprocal motion of said pin tumblers as units being permitted by axial alignment of the pins thereof, at least one of said pins of each of said pin tumblers extending across said shear line so as to be partly disposed in an aligned shell pin tumbler receiving chamber and core pin tumbler receiving chamber in the absence of a properly bitted key in said keyway, said pin tumblers each further including a spring for urging said driver pins in the direction of said keyway whereby said bottom pins extend into said keyway for cooperation with a key;

an auxiliary locking pin having first and second oppositely disposed end portions, said auxiliary locking pin being reciprocally disposed in said core auxiliary locking pin receiving chamber, said auxiliary locking pin defining an axis, said first end portion of said auxiliary locking pin extending into said keyway through said first side thereof, said second end portion of said auxiliary locking pin being sized and shaped to be received in said first recess in said shell interior surface, said first end portion of said auxiliary locking pin including a reaction surface against which a force directed axially with respect to said auxiliary locking pin may be exerted, said reaction surface facing generally toward said keyway first side, said first end portion of said auxiliary locking pin further including a shaped extension which projects beyond said reaction surface toward said second side of said keyway, said shaped extension having a length and defining the first end of said auxiliary locking pin, an auxiliary locking pin spring for applying an axial resilient bias force to said auxiliary locking pin, said auxiliary locking pin spring causing at least part of said second end portion of said auxiliary locking pin to extend across said shear line and be received in said shell first recess when said core and shell pin tumbler chambers are in axial alignment, said receipt of said auxiliary locking pin second end portion in said shell recess under the influence of said auxiliary locking pin spring establishing interference between said auxiliary locking pin second end portion and said recess side wall, said interference preventing rotation of said core relative to said shell in the absence of the application of an axial force to said auxiliary locking pin reaction surface which is in a direction opposite to and in excess of said resilient bias force; and a key, said key comprising a bow and a blade which extends longitudinally from said bow to a blade tip, said blade having a pair of spatially displaced opposite side surfaces which are at least in part substantially parallel, at least one of said side surfaces being provided with a longitudinal slot extending from the vicinity of said tip toward said bow, said longitudinal slot having an open end which faces away from said bow, said slot being in part defined by a base and a force transmission wall which is spacially displaced from said base, said force transmission wall being at least in part generally complementary in shape to at least a portion of said auxiliary locking pin reaction surface, said auxiliary locking pin first end portion being received in said open end of said longitudinal slot, the spacing between said force transmission wall of said slot and said slot base permitting relative longitudinal movement between said blade and said auxiliary locking pin, the average spacing between said force transmission wall of said slot and said keyway first side defining a first slot operational depth at said blade tip and defining a second slot operational depth in a linear section of said slot which is displaced from said blade tip, said section of said slot having said second operational depth being in registration with said auxiliary locking pin when said key blade is fully inserted in said keyway, the operational depth of said slot transitioning smoothly from said first operational depth to said second operational depth, the spacing between said force transmission wall of said slot and said slot base being commensurate with said length of said auxiliary locking pin shaped extension at least in said linear section having said second slot operational depth, said blade further having at least a first aperture in said base of said slot in said linear slot section having said second slot operational depth, said aperture being sized and shaped to receive said auxiliary locking pin shaped extension, insertion of said key blade into said keyway with said locking pin first end portion received in said slot to the point where said slot has transitioned to said second operational depth causing said auxiliary locking pin second end portion to be partially withdrawn from said shell recess, said partial withdrawal interrupting said rotation preventing interference.

13. The lock system of claim 12 wherein said axis of said auxiliary locking pin is oriented generally transversely with respect to said keyway defined plane and said auxiliary locking pin axis intersects said plane at a point displaced from said longitudinal axis.

14. The lock system of claim 12 wherein said first end portion of said auxiliary locking pin in part defines a flaring tenon, said tenon defining said reaction surface.

15. The lock system of claim 12 wherein said auxiliary locking pin second end portion includes a cam surface and said shell first recess side wall is in part defined by a camming surface which is shaped to coact with said camming surface to impart axial motion to said auxiliary locking pin, and wherein said auxiliary locking pin second end portion is further provided with a wall surface which is oriented generally parallelly with respect to said auxiliary locking pin axis and said shell recess side wall has a further surface which extends in a direction parallel to said auxiliary locking pin axis, the length of said further surface being commensurate with the difference between said key blade slot first and second operational depths, said auxiliary locking pin and shell recess parallel wall surfaces coacting to establish said interference and prevent rotation of said core relative to said shell prior to partial withdrawal of said auxiliary locking pin from said first recess, said shell camming surface and said auxiliary locking pin cam surface cooperating to impart axial motion to said auxiliary locking pin in response to relative rotation between said shell and core subsequent to said partial withdrawal of said auxiliary locking pin from said shell first recess, said imparted axial motion being permitted by reception of said shaped extension of said auxiliary locking pin first end portion in said key blade aperture.

16. The lock system of claim 13 wherein said first end portion of said auxiliary locking pin in part defines a flaring tenon, said tenon defining said reaction surface.

17. The lock system of claim 15 wherein said first end portion of said auxiliary locking pin in part defines a flaring tenon, said tenon defining said reaction surface.

18. The lock system of claim 12 wherein said longitudinal slot in said key blade defines a mortise.

19. The lock system of claim 15 wherein said longitudinal slot in said key blade defines a mortise.

20. The lock system of claim 19 wherein said mortise includes said force transmission wall.

21. The lock system of claim 20 wherein said first end portion of said auxiliary locking pin in part defines a flaring tenon, said tenon defining said reaction surface, and wherein said force transmission wall of said mortise is generally complementary in shape to said reaction surface.

22. The lock system of claim 21 wherein said axis of said auxiliary locking pin is oriented generally transversely with respect to said keyway defined plane, and wherein said auxiliary locking pin axis intersects said plane at a point displaced from said longitudinal axis.

23. A key blank for use with a cylinder lock having at least a first resiliently biased auxiliary locking pin, the lock having a keyway with oppositely disposed and spacially separated sides and the locking pin having a shaped head portion which extends into the lock keyway from a first side thereof, the shaped head portion being at a first end of the auxiliary locking pin and including a reaction surface which generally faces the keyway first side, said key blank comprising:

a bow;

a blade longitudinally extending from said bow and terminating at a tip, said blade having first and second spatially displaced sides, said blade also having a pair of oppositely disposed and spaced edges which interconnect said sides, said first and second sides being at least in part substantially parallel to one another;

a slot extending longitudinally along a substantial portion of the length of at least a first of said blade sides from the vicinity of said blade tip in the direction of said bow, said slot defining a mortise sized and shaped to receive an auxiliary locking pin head portion whereby an auxiliary locking pin head portion may be inserted in said slot at said open end and captured therein, said mortise having a base and including a force transmission wall which is spaced from said base and faces generally in the direction of said second of said blade sides, said mortise force transmission wall being at least in part complementary in shape to a portion of the reaction surface of the auxiliary locking pin head portion, said slot having an operational depth defined by the spacing between said blade first side and said force transmission wall, said slot having a first linear section with an average first operational depth, said slot first linear section extending from said slot open end, said slot operational depth transitioning smoothly from said first operational depth to a second operational depth occurring in a second slot linear section, said force transmission wall of said mortise following the operational depth profile of said slot, said second linear section of said slot being located in a longitudinal region along said blade which is displaced from said tip by said first slot section; and at least a first aperture in said base of said slot, said aperture being located in said second linear slot section.

24. The key blank of claim 23 wherein said slot further has a third linear section disposed between said first and second linear sections, wherein said operational depth is substantially constant along said first linear section and wherein said operational depth transitions from said first to second depths in said third linear section.

25. The key blank of claim 23 wherein the spacing between said slot base and said force transmission wall is commensurate with the extension of the locking pin head portion into the keyway at least in said second linear slot section whereby displacement of the auxiliary locking pin head portion reaction surface away from said mortise force transmission wall may occur only when the locking pin head portion is in registration with said first aperture.

26. The key blank of claim 23 wherein said force transmission wall is angularly inclined relative to said slot base.

27. The key blank of claim 23 wherein said slot continues past said second linear section to define a further linear slot section extending toward said bow from said second section, the average operational depth of said slot in said further linear section being less than said second operational depth.

28. The key blank of claim 24 wherein said force transmission wall is angularly inclined relative to said slot base.

29. The key blank of claim 24 wherein said slot continues past said second linear section to define a further linear slot section extending toward said bow from said second section, the average operational depth of said slot in said further linear section being less than said second operational depth.

30. The key blank of claim 28 wherein said slot continues past said second linear section to define a further linear slot section extending toward said bow from said second section, the average operational depth of said slot in said further linear section being less than said second operational depth.

* * * * *

UNITED STATES PATENT AND TRADEMARK OFFICE

CERTIFICATE OF CORRECTION

PATENT NO. : 5,823,029

DATED : October 20, 1998

INVENTOR(S) : Charles W. Eden, Jr., et al

It is certified that error appears in the above-identified patent and that said Letters Patent is hereby corrected as shown below:

On the title page at item [*], change "5,154,056"--5,819,556--.

Signed and Sealed this

Fifteenth Day of June, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,823,029

DATED : October 20, 1998

INVENTOR(S) : Charles W. Eden, Jr., et al

It is certified that error appears in the above-indentified patent and that said Letters Patent is hereby corrected as shown below:

On the title page at item [*], change "5,154,056" to --5,819,566--.

Signed and Sealed this

Twelfth Day of October, 1999

*Attest:*

Q. TODD DICKINSON

*Attesting Officer*

*Acting Commissioner of Patents and Trademarks*